US009851186B2

(12) United States Patent
Brown

(10) Patent No.: US 9,851,186 B2
(45) Date of Patent: Dec. 26, 2017

(54) HIGH SPIN PROJECTILE APPARATUS FOR SMOOTH BORE BARRELS

(71) Applicant: James F. Brown, Clifton, VA (US)

(72) Inventor: James F. Brown, Clifton, VA (US)

( * ) Notice: Subject to any disclaimer, the term of this patent is extended or adjusted under 35 U.S.C. 154(b) by 0 days.

(21) Appl. No.: 15/078,077

(22) Filed: Mar. 23, 2016

(65) Prior Publication Data

US 2016/0282094 A1 Sep. 29, 2016

Related U.S. Application Data

(60) Provisional application No. 62/136,862, filed on Mar. 23, 2015.

(51) Int. Cl.
*F42B 10/26* (2006.01)
*F42B 14/06* (2006.01)

(52) U.S. Cl.
CPC ..... *F42B 10/26* (2013.01); *F42B 14/06* (2013.01)

(58) Field of Classification Search
CPC ..... F42B 10/26–10/30; F42B 14/061–14/08
See application file for complete search history.

(56) References Cited

U.S. PATENT DOCUMENTS 1,380,172 A * 5/1921 Abbot ..... F42B 30/10 102/491
3,058,423 A * 10/1962 Laager ..... F42B 10/26 244/3.23
3,247,795 A * 4/1966 Abela ..... F42B 10/26 102/436
3,726,231 A 4/1973 Kelly et al.
3,800,706 A * 4/1974 Gawlick ..... F42B 10/54 102/529
4,249,465 A * 2/1981 Ballmann ..... F42B 10/26 102/430
4,314,510 A * 2/1982 Jeter ..... F42B 10/26 102/521
4,886,223 A * 12/1989 Gartner ..... F42B 10/28 244/3.23
5,214,238 A 5/1993 Young
(Continued)

OTHER PUBLICATIONS

Spencer, Jr., "Hypersonic Aerodynamic Characteristics of Minimum Wave Drag Bodies Having Variations in Cross-Sectional Shape," National Aeronautics and Space Administration, NASA Technical Note NASA TN D-4079, Washington, DC, Sep. 1967.
(Continued)

*Primary Examiner* — Stephen Johnson
*Assistant Examiner* — Joshua T Semick
(74) *Attorney, Agent, or Firm* — Kilyk & Bowersox, P.L.L.C.

(57) ABSTRACT

A projectile apparatus is provided that includes a projectile, a propellant, and optional components such as a wading, a sabot, and an intermediary device. The projectile can be fired through a barrel having a smooth bore. A sabot is provided that can include molded features, for example, a base portion and a plurality of petal portions defining, in-part, a volume for accommodating a projectile. The sabot and wadding can include molded features that control and direct gases produced by the propellant. The apparatus can convert gas pressure or gas velocity into a high rate of projectile spin. The projectile has long-range accuracy due to a high or sustainable velocity and high rate of spin.

6 Claims, 6 Drawing Sheets

(56) References Cited

U.S. PATENT DOCUMENTS

| | | | | |
|---|---|---|---|---|
| 5,297,492 | A | 3/1994 | Buc | |
| 5,328,130 | A * | 7/1994 | Gilman | F42B 10/26 102/439 |
| 5,415,102 | A | 5/1995 | White et al. | |
| 6,085,660 | A | 7/2000 | Campoli et al. | |
| 6,453,820 | B1 * | 9/2002 | Anderson | F42B 10/24 102/439 |
| 7,150,234 | B2 * | 12/2006 | Gilman | F42B 8/12 102/501 |
| 7,222,573 | B2 * | 5/2007 | Pontieri | F42B 6/10 102/501 |
| 8,844,443 | B2 * | 9/2014 | Tomov | F42B 10/30 102/490 |
| 2002/0134273 | A1 * | 9/2002 | Mihaylov | F42B 14/04 102/439 |

OTHER PUBLICATIONS

Crowell Sr., "The Descriptive Geometry of Nose Cones" (1996).
Santos, "Leading-Edge Bluntness Effects on Aerodynamic Heating and Drag of Power Law Body in Low-Density Hypersonic Flow," J. of the Braz. Soc. of Mech. Sci. & Eng., vol. XXVII, No. 3 (pp. 236-242) (Jul.-Sep. 2005).

* cited by examiner

HIGH SPIN PROJECTILE APPARATUS FOR SMOOTH BORE BARRELS

CROSS-REFERENCE TO RELATED APPLICATION

The present application claims priority to U.S. Provisional Patent Application No. 62/136,862, filed Mar. 23, 2015, which is incorporated herein in its entirety by reference.

FIELD OF THE INVENTION

The present invention relates to accurate, extended-range firearms ammunition for use with smooth bore pistols, rifles, shotguns, muzzle loading guns, and the like.

BACKGROUND OF THE INVENTION

Whether of small or large caliber, the rifled barrel has dominated projectile weapons as a means of introducing flight-stabilizing spin to the projectile. Rifled barrel twist rates from 1:36 or less to 1:7 or more produce rotational rates of from 30,000 to 300,000 RPM or more, which is sufficient to stabilize projectiles with length to diameter ratios of up to 5:1 or more. At any caliber or ratio, such projectiles from un-rifled barrels readily tumble, which greatly reduces accuracy and range.

The use of single-projectile bullets or slugs with smooth-bore shotguns has a long history of innovation to increase range and accuracy. U.S. Pat. No. 3,726,231 discloses a waisted slug known as the BRI slug or bullet. Such waisted slugs grew to prominence in the 1970's and 1980's. The hollowed aft portion of the Foster slug improves accuracy by placing more mass in the front of the projectile, therefore reducing to some degree the tumble of solid slugs. The Brenneke slug achieves a similar result by retaining connection with the lower density wadding during flight, thereby increasing range and accuracy in smooth bore guns.

The late 20th century saw increased interest in use of the shotgun slug, which was motivated in part by a combination of user preference and regulatory mandate, especially on relatively flat terrain and in densely populated areas. The availability of rifled shotgun barrels also increased; however, this enhanced slug performance came at much higher cost for the shotgun and at the expense of unsatisfactory bird and buck shot performance; bird or buck shot from a rifled barrel can produce a hollow ring pattern. In addition, any gun with a rifled barrel may not be legally classified as a shotgun in some districts; therefore, prohibiting their use for hunting.

Nevertheless, there have been ongoing development efforts in sabot-shuttled projectile technology intended for firing through rifled barrels. U.S. Pat. No. 5,214,238 discloses a sabot for chambering conventional or sub-caliber bullets in a rifled shotgun. Sub-caliber bullets from less than .22 caliber to greater than .50 caliber have been disclosed. U.S. Pat. No. 5,415,102 discloses a muzzle loading sabot-shuttled bullet. These sub-caliber rounds provide higher kinetic energy, range, and accuracy over full-sized slugs.

Sources of projectile inaccuracies include wind, the effect of gravity during long flight times, and variations in gun powder charge and drag. Drag causes bullet velocity to decrease, which increases the time of flight to a target and the subsequent effect of gravity and wind. Slugs and full-caliber projectiles are especially subject to drag because of their relatively large diameters.

The types of drag that act on transonic and hypersonic bullets are from aerodynamic shock waves, skin friction, and base vacuum at the back of the projectile. U.S. Pat. No. 5,297,492 discloses a sabot shuttled sub-caliber projectile having a fin stabilized sub-caliber projectile further comprising an internal blind core filled with a tracer or propellant composition in part to reduce base vacuum drag at the rear of the projectile. Fins increase drag, but this is offset by the smaller diameter projectile. Sub-caliber, sabot-shuttled bullets without fins but fired through rifled barrels demonstrate comparable extended range and accuracy.

Bullet or projectile shape has a predictable effect on range, and ideal shapes and dimensions cannot be used without either a sabot or rifled barrel or a sabot with a finned projectile, FIG. 1 shows a comparison of drag characteristics for various nose shapes in the transonic to low Mach regions. The rankings shown in FIG. 1 are: superior (1), good (2), fair (3), and inferior (4). As illustrated in the graph shown in FIG. 1, the aerodynamic Von Karman and ¾ Parabola shapes have the lowest drag at transonic and hypersonic velocities. See, Gary A. Crowell, Sr., *The Descriptive Geometry Of Nose Cones* (1996). The cone profile disclosed in U.S. Pat. No. 5,297,492 has poor performance at velocities between Mach 0.8 and Mach 2.2. Mach 1.0 in dry air at 68° F. is 1,125 feet per second, and shotgun slug muzzle velocities typically range between Mach 1.2 and 1.8.

In U.S. Pat. No. 6,085,660, Campoli et. al. disclose a cannon sabot that allows "flow of a portion of the gas through the sabot" partially transverse to the barrel axis to counter the rotation caused by the rifling for finned projectiles or causing a low speed rotation of up to 6,000 rotations per minute from a smooth bore. This reduced rate of rotation helps stabilize finned projectiles, but it is insufficient to stabilize non-finned projectiles.

Regardless of caliber, there is a need for full caliber and sub-caliber non-finned ammunition that can spin-stabilize projectiles when fired through a smooth bore.

SUMMARY OF THE INVENTION

The present invention provides a projectile apparatus comprising a projectile, a propellant, and optionally a wadding, a sabot, or both. The projectile apparatus can provide a projectile rate of spin of 30,000 RPM or greater and can be fired with accuracy and extended range through a smooth bore barrel. The projectile apparatus one or more elements or features for converting a portion of the gas pressure (potential energy) generated by combustion of the propellant into a high rate of projectile spin (kinetic energy) as the projectile moves through a smooth, un-rifled barrel. The energy required to achieve this degree of rotation is less than or comparable to the energy ordinarily used to overcome the friction and deformation caused by forcing a bullet through a rifled barrel. The projectile apparatus can further comprise one or more intermediary components, elements or features for providing communication between one or more of the bullet, the sabot, and the wadding, or for directing the flow of combustion gases. In some embodiments, the bullet or projectile further comprises a device or means for providing thrust and/or for reducing back drag after exiting the barrel.

BRIEF DESCRIPTION OF THE DRAWINGS

The present invention can be even better understood with reference to the appended drawings that are intended to illustrate, not limit, the present invention.

DETAILED DESCRIPTION OF THE INVENTION

Figure 1:
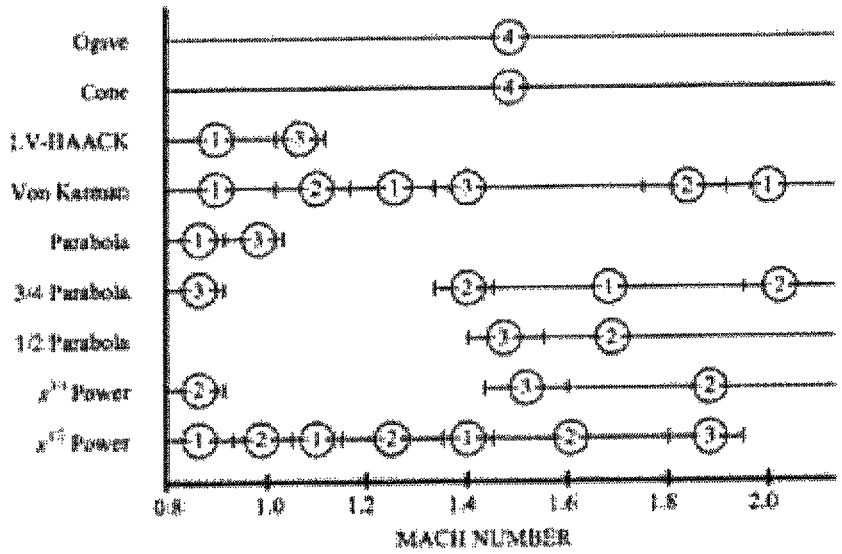
FIG. 1 is a graph showing a comparison of drag characteristics for various nose shapes in the transonic to low Mach regions. The rankings shown in FIG. 1, used to characterize the shapes, are: superior (1), good (2), fair (3), and inferior (4).

In one or more embodiments of the present invention, an element or feature of the projectile apparatus, configured to convert blast pressure from burring propellant to effect projectile spin, comprises one or more turbine structures. If more than one turbine structure is provided, the turbine structures can each be the same as or different from at least one other. These structures can be implemented as part of the projectile, part of a sabot, part of a wadding, part of an intermediary component, the entirely of any such component, or a combination thereof. For example, the projectile apparatus can have a wadding that comprises fins, vents, or channels that direct a flow of combustion gases into communication with turbine elements integral with a sabot, causing the sabot and a captured projectile it contains to spin at a high rate, while the wadding, acting as a turbine stator, does not spin substantially relative to the barrel. A system including the projectile apparatus, a projectile, and a smooth bore barrel, is also provided, as is a method of using the system.

According to various embodiments of the present invention, a sabot is provided that comprises fins, vents, or channels that direct a flow of combustion gases into communication with turbine elements that are part of the projectile, wherein the sabot is substantially not in rotation relative to the barrel while the projectile spins inside the sabot. In yet other embodiments of the present invention, a wadding is included that can regulate, direct, control, or a combination thereof, the flow of combustion gases into turbine elements of the projectile, causing the projectile to spin at a high rate of speed while the wadding is substantially prevented from rotation relative to the barrel. The wadding can be prevented from spinning, for example, due to friction. In still other embodiments of the present invention, one or more intermediary elements or components are included that can regulate, direct, control, or a combination thereof, the flow of combustion gases into turbine elements of the projectile, causing the projectile to spin at a high rate of speed while the wadding is substantially prevented from rotation relative to the barrel. The intermediary elements or components can be prevented from spinning, for example, due to friction. In other embodiments, the intermediary components may mechanically link two or more of the projectile, the sabot or the wadding. A system comprising such a sabot, a projectile, and a smooth bore barrel, as well as a method using the system, are also provided.

In each of the various embodiments described above, the projectile, sabot, intermediary components, or wadding can have features that reduce friction against the barrel. It is to be understood that such embodiments do not preclude either the projectile, the sabot, the intermediary components, or a combination thereof, from being acted-upon directly by combustion gases, without regulation, control, or direction from another device.

According to various embodiments of the present invention, a projectile apparatus is provided that comprises a propellant and a projectile. The projectile apparatus is configured to spin when fired from a smooth bore barrel. The propellant can comprise a combustible material that produces exhaust gases when burned. The projectile apparatus is configured to direct the exhaust gases from the burning propellant away from the projectile as the propellant is burned. The projectile can comprise one or more elements or features for converting gas pressure or velocity from the propellant, as the propellant is burned, to a high rate of projectile spin within the smooth bore barrel. The high rate of projectile spin can be greater than 30,000 rotations per minute upon exiting the barrel, for example, greater than 50,000 rotations per minute, greater than 70,000 rotations per minute, or greater than 100,000 rotations per minute. In some cases, the high rate of projectile spin upon exiting the barrel is greater than 200,000 rotations per minute. The one or more elements or features can comprise a turbine element, and the turbine element can be one of an impulse turbine element, a reactive turbine element, a centripetal turbine element, a Tesla turbine element, or a combination thereof. The one or more elements or features can be configured to regulate, control, and direct gases produced by the propellant as the propellant is burned, into the turbine element. The one or more elements or features can comprise vanes, blades, channels, nozzles, a stator, or a combination thereof. If a turbine element is provided as part of the projectile or an intermediary component in communication with the projectile, the turbine element can be configured to cause the projectile to spin upon burning the propellant. The projectile can have an aerodynamic profile, for example, conforming to a Von Karmen profile, a ¾ parabola profile, or an x¾ power profile. The projectile can comprise, but is not limited to, a material having a density of from about 8 grams per cubic centimeter to about 19 grams per cubic centimeter. The projectile can comprise one or more of copper, lead, tantalum, uranium, and tungsten. The projectile can comprise magnetic components, rare earth magnetic components, ceramic magnetic components, or combinations thereof. The projectile can comprise materials having a density of less than 8 grams per cubic centimeter. The projectile can, for example, comprise the alkali and alkali earth metals, lithium, sodium, potassium, beryllium, or magnesium. The projectile can comprise combustible materials. Features of the projectile may change in a dimension or shape through combustion of materials comprising the projectile. The projectile can have a caliber of .22, .30, .38, .44, .45, or .50. The projectile can comprise one or more channels or ducts beginning at, or near, the rear of the projectile and extending to, or near, the front of the projectile. The one or more channels or ducts can be configured to convey exhaust gas from the propellant as the propellant is burned, to one or more rotational nozzles or jets configured to direct exhaust to a smooth bore barrel ahead of the projectile. The propellant may be formed to have a shape controlling the location of ignition and rate of burning.

According to various embodiments of the present invention, a method is provided that comprises placing the projectile in a smooth bore barrel and igniting the propellant to cause the propellant to burn and form exhaust gases. According to the method, the one or more elements or features can direct the exhaust gases such that the exhaust gases cause the projectile to spin in the smooth bore barrel. The exhaust gases can cause the projectile to exit the smooth bore barrel at a rate of projectile spin that is greater than 30,000 rotations per minute, for example, greater than 100,000 rotations per minute or greater than 200,000 rotations per minute. The projectile apparatus can exit the smooth bore barrel at a muzzle velocity of from about Mach 1.0 to about Mach 3.0 or more.

According to various embodiments of the present invention, a projectile apparatus is provided that comprises a propellant, a projectile, and a sabot, wherein the projectile apparatus is configured to spin when fired from a smooth bore barrel. The propellant can comprise a combustible material that produces exhaust gases when burned, and the projectile apparatus can be configured to direct the exhaust gases from the propellant away from the propellant as the propellant is burned. One or both of the projectile and the sabot can comprise one or more elements or features for converting gas pressure or velocity from the propellant, as the propellant is burned, to a high rate of projectile spin within the smooth bore barrel. The high rate of projectile spin can be greater than 30,000 rotations per minute upon exiting the barrel, for example, greater than 50,000 rotations per minute, greater than 70,000 rotations per minute, or greater than 100,000 rotations per minute. In some cases, the high rate of projectile spin upon exiting the barrel is greater than 200,000 rotations per minute. The sabot can comprise a turbine element and the turbine element is one of an impulse turbine element, a reactive turbine element, a centripetal turbine element, a Tesla turbine element, or a combination thereof. The sabot can comprise one or more elements or features configured to regulate, control, and direct gases produced by the propellant as the propellant is burned, into the turbine element. The one or more elements or features can comprise vanes, blades, channels, nozzles, a stator, or a combination thereof. The projectile apparatus can comprise one or more channels or ducts that begin at, or near, the rear of the projectile apparatus and extend to, or near, the front of the projectile apparatus. The one or more channels or ducts can be configured to convey exhaust gas from the propellant as the propellant is burned, to one or more rotational nozzles or jets configured to direct exhaust gases to the smooth bore barrel ahead of the projectile apparatus. The projectile apparatus can further comprise an intermediary component, and the intermediary component can comprise one or more elements or features configured to regulate, control, and direct gases produced by the propellant, as the propellant is burned, into the turbine element. The projectile can comprise a device or means for reducing drag, adding thrust, or both. The device or means can comprise an air breathing or self-oxidizing element or feature. The sabot can be configured to have substantially greater friction against the smooth bore barrel and reduced propensity to rotate, compared to the projectile. According to various embodiments of the present invention, a method is provided that comprises placing the projectile apparatus in a smooth bore barrel and igniting the propellant to cause the propellant to burn and form exhaust gases. The one or more elements or features can be configured to direct the exhaust gases such that the exhaust gases cause the projectile to spin in the smooth bore barrel. The exhaust gases can cause the projectile to exit the smooth bore barrel at a rate of projectile spin that can be greater than 30,000 rotations per minute, for example, greater than 50,000 rotations per minute, greater than 70,000 rotations per minute, or greater than 100,000 rotations per minute. In some cases, the high rate of projectile spin upon exiting the barrel is greater than 200,000 rotations per minute. The projectile apparatus can be configured to cause the projectile to exit the smooth bore barrel at a muzzle velocity of from about Mach 1.0 to about Mach 3.0 or more.

According to yet other embodiments of the present invention, a projectile apparatus is provided that comprises a propellant, a projectile, and a wadding, wherein the projectile apparatus can be configured to spin when fired from a smooth bore barrel. The propellant can comprise a combustible material that produces exhaust gases when burned, and the projectile apparatus can be configured to direct the exhaust gases from the propellant away from the propellant as the propellant is burned. One or both of the projectile and the wadding CAN comprise one or more elements or features for converting gas pressure or velocity from the propellant, as the propellant is burned, to a high rate of projectile spin within the smooth bore barrel. The high rate of projectile spin can be greater than 30,000 rotations per minute upon exiting the barrel, for example, greater than 50,000 rotations per minute, greater than 70,000 rotations per minute, or greater than 100,000 rotations per minute. In some cases, the high rate of projectile spin upon exiting the barrel is greater than 200,000 rotations per minute. The projectile apparatus can be configured to cause the projectile to exit the smooth bore barrel at a muzzle velocity of from about Mach 1.0 to about Mach 3.0 or more. The wadding can comprise a turbine element, and the turbine element can be one of an impulse turbine element, a reactive turbine element, a centripetal turbine element, a Tesla turbine element, or a combination thereof. The wadding can comprise one or more elements or features that are configured to regulate, control, and direct gases produced by the propellant as the propellant is burned, into the turbine element. The one or more elements or features can comprise vanes, blades, channels, nozzles, a stator, or a combination thereof. The wadding can comprise one or more channels or ducts beginning at, or near, the rear of the projectile and extending to, or near, the front of the projectile. The one or more channels or ducts can be configured to convey exhaust gas from the propellant as the propellant is burned, to one or more rotational nozzles or jets that are configured to direct the exhaust gases to the smooth bore barrel ahead of the projectile. The projectile apparatus can further comprise an intermediary component and the intermediary component can comprise one or more elements or features configured to regulate, control, and direct gases produced by the propellant, as the propellant is burned, into the turbine element. The projectile can comprise a device or means for reducing drag, adding thrust, or both. The projectile can comprise an air breathing or self-oxidizing device or means. The projectile apparatus can further comprise a sabot and an intermediary component, and the intermediary component can be positioned between the wadding and the sabot. The intermediary component can comprise a mechanical coupling between the wadding and the sabot. The wadding can be configured to have substantially greater friction against the smooth bore barrel and reduced propensity to rotate, compared to the projectile. According to yet other embodiments of the present invention, a method is provided that comprises placing the projectile apparatus in a smooth bore barrel and igniting the propellant to cause the propellant to burn and form exhaust gases. The one or more elements or features can be configured to direct the exhaust gases such that the exhaust gases cause the projectile to spin in the smooth bore barrel. The exhaust gases can cause the projectile to exit the smooth bore barrel at a rate of projectile spin that is greater than 30,000 rotations per minute, for example, greater than 50,000 rotations per minute, greater than 70,000 rotations per minute, or greater than 100,000 rotations per minute. In some cases, the high rate of projectile spin upon exiting the barrel is greater than 200,000 rotations per minute. The projectile apparatus can be configured to cause the projectile to exit the smooth bore barrel at a muzzle velocity of from about Mach 1.0 to about Mach 3.0 or more.

According to yet other embodiments of the present invention, a method is provided for inducing a high rate of spin on a projectile in a barrel having a smooth bore. The method comprises causing a propellant to burn and produce combustion gases at pressures of about 10,000 PSI or more, in the form of potential energy. A turbine element is coupled to a projectile, and the turbine elements are configured to convert the potential energy of the combustion gases to kinetic rotational energy of the coupled turbine element and projectile. The method comprises using the turbine element to convert the potential energy into kinetic rotational energy of the coupled turbine element and projectile so as to cause the projectile to spin at a rate of 30,000 RPM or greater, for example, at a rate of greater than 50,000 rotations per minute, greater than 70,000 rotations per minute, or greater than 100,000 rotations per minute. In some cases, the high rate of projectile spin upon exiting the barrel is greater than 200,000 rotations per minute. The projectile apparatus can be configured such that the method causes the projectile to exit the smooth bore barrel at a muzzle velocity of from about Mach 1.0 to about Mach 3.0 or more. A wadding, sabot, or both, can further be coupled to the turbine element and projectile to regulate, control, and direct the flow of combustion gases into the turbine element, thereby increasing efficiency of the conversion from the potential energy to the kinetic rotational energy. Drag on the projectile after leaving the barrel can be reduced. The projectile velocity after leaving the barrel can be substantially maintained or increased. By using the turbine element to convert the potential energy to kinetic energy, the projectile can be caused to spin at a rate of 300,000 RPM or greater.

The turbine structure can operate generally by impulse, reaction, or a combination of the two. For impulse turbines, there is no need to generate a pressure change between the working fluid or combustion gas in the rotor or turbine elements (for example, the moving blades). No pressure casement is required around the rotor because the fluid jet is created by the nozzle prior to reaching the rotor or turbine elements. The pressure drop takes place in the stationary blades, nozzles, fins, guides, ducts, or stator. Before reaching the turbine, the pressure head of the fluid is changed to velocity head by accelerating the fluid by these elements and features.

Figure 2:
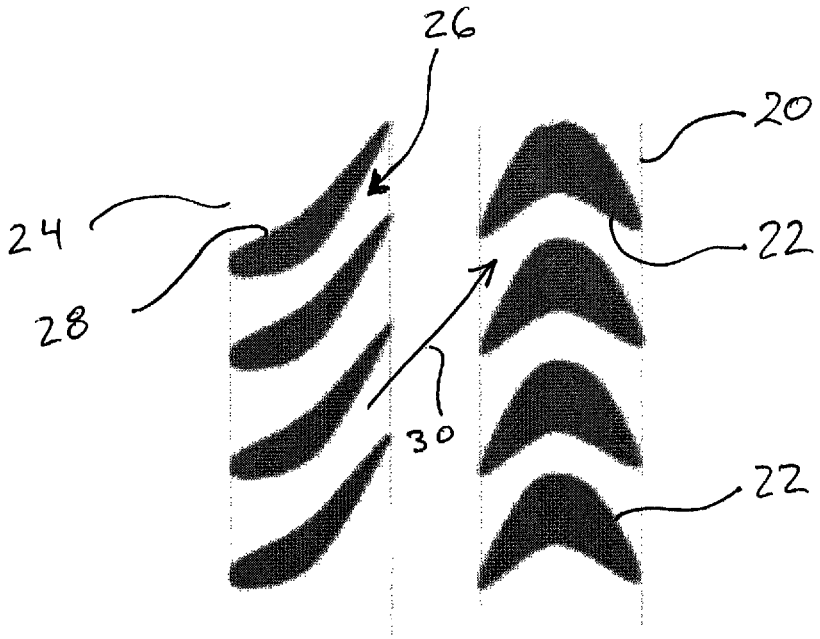
FIG. 2 is a schematic diagram showing the orientation of nozzles for directing combustion gases into impulse turbine rotor elements or blades, in a projectile apparatus according to various embodiments of the present invention.

FIG. 2 illustrates the structure of such an impulse nozzle-turbine or stator-turbine arrangement. As shown in FIG. 2, a rotor structure 20, also referred to as a turbine element structure, is provided with a plurality of turbine blades 22. A nozzle structure 24 comprises a plurality of nozzles 26 defined by a plurality of fins 28. Nozzles 26 are oriented such that they direct combustion gases into impulse turbine blades 22 of rotor structure 20. Directional arrow 30 shows the direction of combustion gases leaving nozzles 26 and directed toward turbine blades 22. According to such embodiment of the present invention, nozzle structure 24 can be a molded, machined, or otherwise formed structure of the wadding, the sabot, or some intermediary device. Rotor structure 20, on the other hand, can be a feature of either the sabot, if not used as the stator, or the projectile. In some cases, nozzle structure 24 can be a feature of the wadding, jetting combustion gases directly into turbine blades of the projectile.

Figure 3:
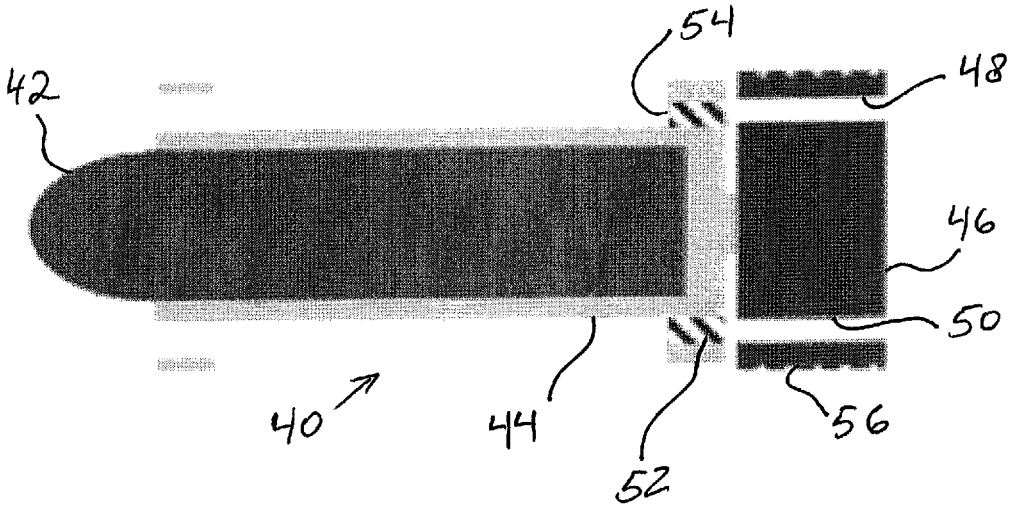
FIG. 3 is a side cross-sectional view of a projectile apparatus according to various embodiments of the present invention and showing fins, ducts, and nozzles formed in the wadding, which direct combustion gases at an angle into the blades of an impulse turbine.

In one or more embodiments of the present invention, as shown in FIG. 3, a projectile apparatus 40 is provided that comprises a projectile 42, a sabot 44, and a wadding 46. High pressure combustion gases from a burning propellant (not shown) enter channels 48 and 50 that pass through wadding 46 and are directionally and symmetrically vented against blades 52 of an impulse turbine 54 that is integral to the rear end of sabot 44. FIG. 3 shows fins, ducts, or nozzles 56 formed in wadding 46, which direct combustion gases at an angle into blades 52 of impulse turbine 54. Friction against a smooth bore barrel prevents wadding 46 from spinning, while sabot 44 is able to spin more or less freely in the smooth bore barrel. Various compositions, elements, and other mean can be used to reduce friction between sabot 44 and the smooth bore barrel wall so that sabot 44 spins with minimal resistance. An element or feature can be used to reduce frictional spin coupling between wadding 46 and sabot 44. In some cases, although not shown in FIG. 3, wadding channels 48 and 50 can direct flow to an impulse turbine integral to the projectile. In yet other embodiments, an optional intermediary device, situated between the wadding and sabot or projectile, can comprise the impulse turbine. Gases exhausted ahead of the sabot or projectile can have little influence in retarding forward acceleration out of the barrel.

Figure 4:
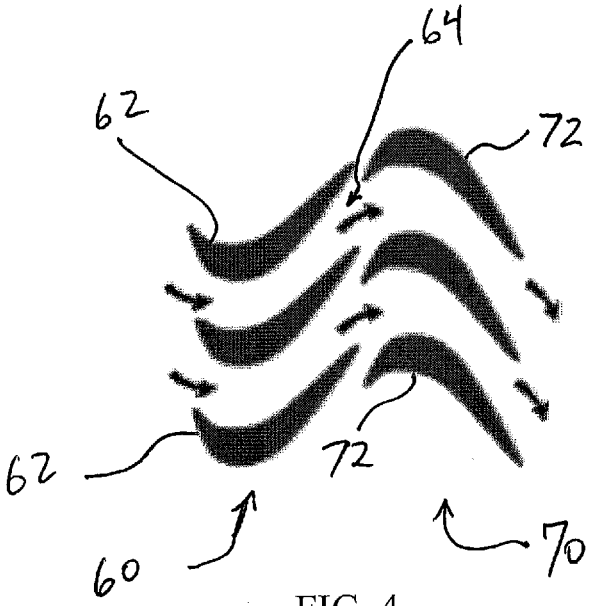
FIG. 4 is a schematic diagram showing how combustion gases can be directed by a stator into the blades of a reaction turbine in a projectile apparatus according to various embodiments of the present invention.

As shown in FIG. 4, high pressure combustion gases from burning propellant can be exhausted in the direction shown by the directional arrows, through a stator structure 60 and into a rotor structure 70. Stator structure 60 comprises of plurality of fins 62 that define a plurality of nozzles 64. High pressure combustion gases exiting nozzles 64 are directed against turbine blades 72 of rotor structure 70, causing rotor structure 70 to spin. Rotor structure 70 is part of a reaction turbine that develops torque by reacting to gas or fluid pressure or mass directed against the rotor or turbine blades. Combustion gases can be directed by stator structure 60 into blades 72 of rotor structure 70. The pressure of the gas or fluid changes as it passes through the turbine rotor blades. A pressure casement can be used to contain the working fluid because there is a change in pressure across the blades. Single stage reaction turbines can be used that are free of a stator, and working fluids can enter the rotor parallel to the axis of rotation.

In some embodiments of the present invention, the optional stator element is used, and is similar to the nozzle, vanes, or ducts of the impulse turbine structures described above. The stator element can be a formed feature of the wadding, sabot, or an intermediary device, and the rotor or turbine can be an integral formed feature of the sabot or projectile. The wadding or sabot, with stator functionality, is optional in reaction turbines according to various embodiments of the present invention. In some embodiments, a stator element can be present in a wadding, a sabot, or both.

Figure 5A:
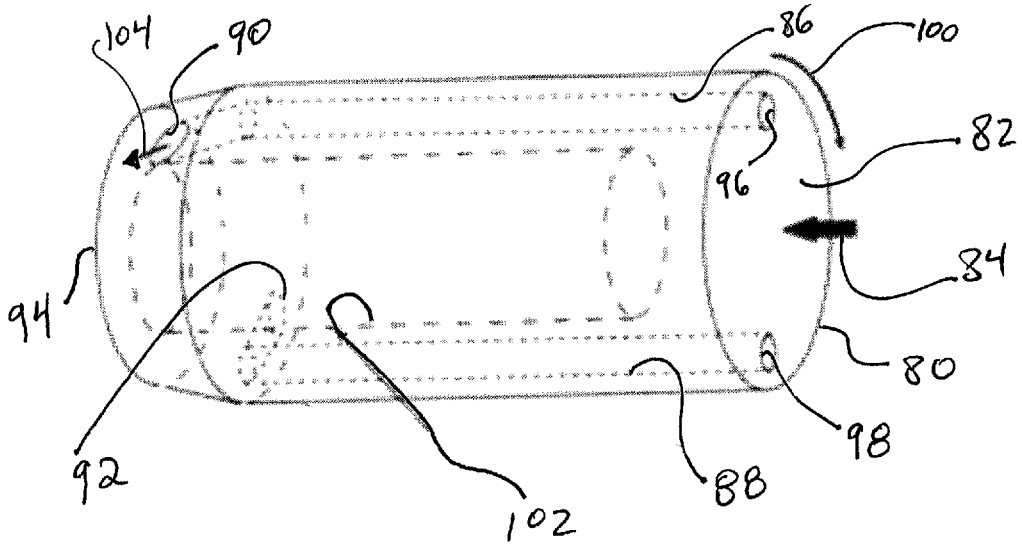
FIG. 5A is a side, back perspective view showing exhaust gas flow passageways and a projectile chamber in phantom, wherein the flow passageways enable high pressure combustion gases to be directed into channels in the sabot and vented at the front of the sabot transversely to the axis of the barrel, causing rotation of the sabot. A projectile is not shown in FIG. 5A
Figure 5B:
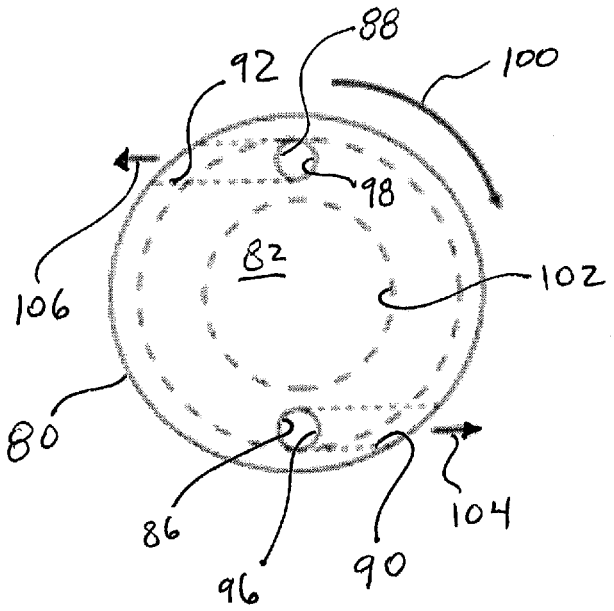
FIG. 5B is a back end view of the sabot shown in FIG. 5A.

FIGS. 5A and 5B show a sabot 80 according to various embodiments of the present invention. In the embodiment of the present invention exemplified in FIGS. 5A and 5B, high pressure combustion gases act on a rear end 82 of sabot 80, in the direction shown by directional arrow 84. The gases are vented from the rear of sabot 80 through two symmetrically located vent tubes 86 and 88, shown in phantom, that intersect tangential jets 90 and 92, respectively, near a front end 94 of sabot 80. As shown in FIGS. 5A and 5B, high pressure combustion gases are directed into channels in the sabot and vented at the front of the sabot transversely to the axis of a smooth bore barrel, causing rotation of sabot 80 in the barrel. The rotation occurs in the direction depicted by directional arrow 100. The directions of thrust caused by combustion gases exiting tangential jets 90 and 92 are shown by directional arrows 104 and 106, respectively. Vent tubes 86 and 88 have entrance openings 96 and 98, respectively. Sabot 80 comprises a cavity 102, shown in phantom, for accommodating a projectile. A projectile is not shown in FIGS. 5A and 5B. While significant pressure losses of nearly 50% can accrue at the near right angle between vent tubes 86 and 88 and the respective tangential jets 90 and 92, the simplicity of the design is exemplary of a reaction turbine sabot according to various embodiments of the present invention.

The reaction turbine aspects described above can be applied to a bullet or projectile directly, without a stator. Examples include gas checks or other sealing features, lubricants and other friction reducing features, combinations of these features, and the like. For example, a wadding having combustion gas-controlling or gas-regulating features can be provided, an anti-spin coupling device between the projectile or sabot and the wadding can be provided, or the like.

Figure 6A:
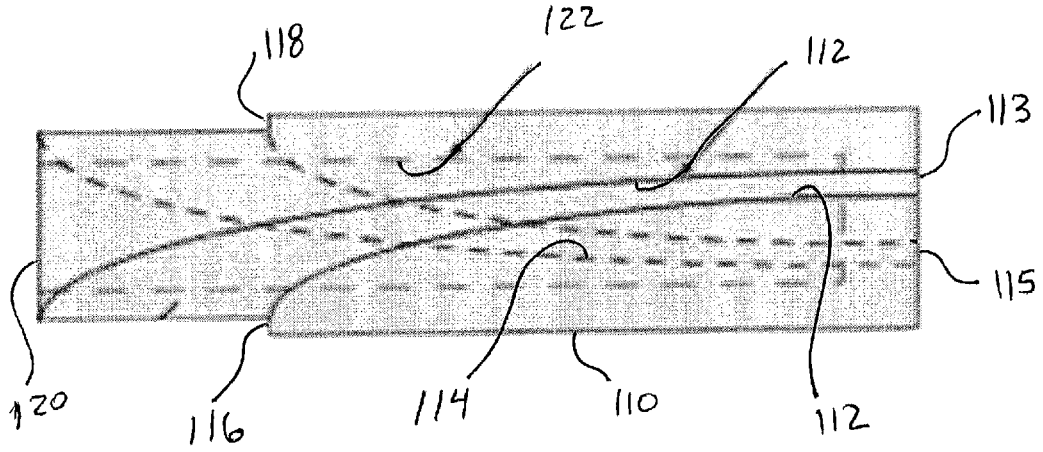
FIG. 6A is a side view in partial phantom showing channels in the wall of a sabot according to various embodiments of the present invention and which are aerodynamically turned transversely to the axis of the barrel, causing torque and rotation. A projectile is not shown in FIG. 6A.
Figure 6B:
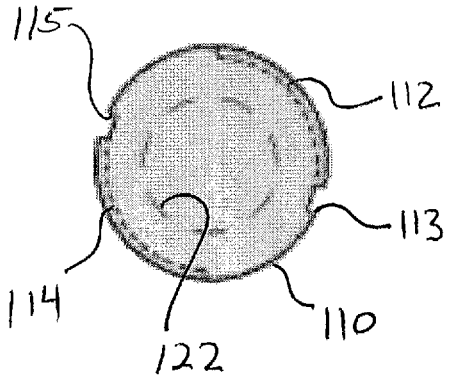
FIG. 6B is a back end view of the sabot shown in FIG. 6A, in partial phantom.

In yet other embodiments of a reaction turbine projectile apparatus of the present invention, the projectile or a sabot holding a projectile can be configured as shown in FIGS. 6A and 6B. The embodiment exemplified in FIGS. 6A and 6B demonstrates how combustion gases can enter channels in the wall of a sabot and be aerodynamically turned transversely to the axis of a smooth bore barrel, causing torque and rotation. A projectile is not shown in FIGS. 6A and 6B. As shown, a sabot 110 comprises one or more expansion channels 112 and 114 that have respective blast inlets or entrance openings 113 and 115. Combustion gases can enter expansion channels 112 and 114 through respective entrance openings 113 and 115 at the rear end of sabot 110. The combustion gases can work against sabot 110 as the gases travel down the expansion channels, changing directions, exiting at respective exhaust jets 116 and 118 at a front end 120 of sabot 110, and causing rotation of sabot 110. Exhaust gases are vented from exhaust jets 116 and 118 down a smooth bore barrel ahead of the projectile and ahead of sabot 110. Sabot 110 has an interior cavity 122 for accommodating a projectile. While not shown, this example, as with others, can include gas checks or other sealing features, lubricants and other friction-reducing features, and combinations of these elements and features. In addition, or instead, a wadding can be provided that has combustion gas-controlling or gas-regulating features, an anti-spin coupling device can be provided between the projectile or sabot and the wadding, a combination thereof can be provided, or the like.

Figure 7:
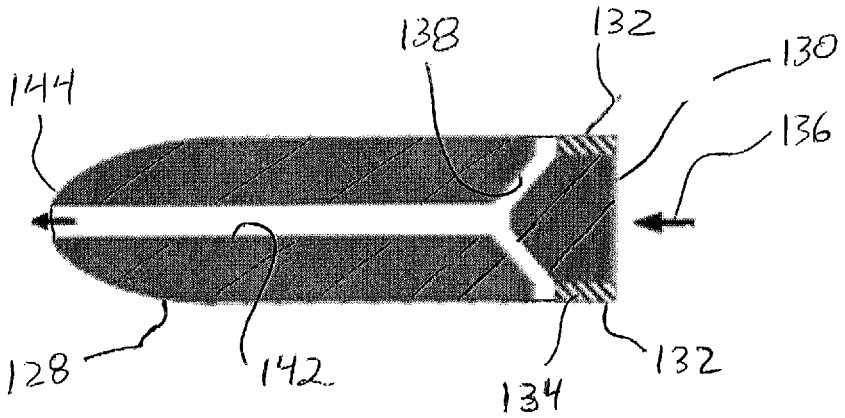
FIG. 7 is a cross-sectional side view of a projectile apparatus according to various embodiments of the present invention and showing how, without fins or vanes, a flow of gas can be directed to a turbine.

In some embodiments, a turbine element integral to the projectile can be configured as either an impulse or reaction turbine. FIG. 7 exemplifies a projectile apparatus according to various embodiments of the present invention that forms an undirected flow of combustion gases into an integral reaction turbine. The embodiment exemplified in FIG. 7 is free of fins or vanes to direct the flow of gas to the turbine. A projectile 128 can be placed adjacent a wadding 130, in a smooth bore barrel. Wadding 130 comprises a turbine structure 132 that comprises a plurality of turbine blades 134. Turbine blades 134 can be implemented as reaction blades. Combustion gas pressure can enter the turbine directly, in the direction shown by directional arrow 136. Momentum can be transferred to blades 134, and the exhaust gas can be directed at a rear end 138 of projectile 128, and exhausted through a center duct 142 toward a front end 144 of projectile 128. In some cases, wadding 130 can be configured to direct the gas flow at an angle into turbine structure 132 such that turbine can be implemented as an impulse turbine.

In yet other embodiments of the present invention, a rotation-producing element or feature is provided that converts blast pressure to rotation and can comprise a centrifugal or radial turbine. In such embodiments, there is a drop in static pressure and kinetic energy of the flowing gas, or working fluid, which is converted to torque on an impeller. The impeller element can be an element or feature of the projectile or sabot, and flow to the impeller can be guided by a wadding. Other suitable intermediary devices can be used to direct the flow of blast pressure to the impeller.

Figure 8:
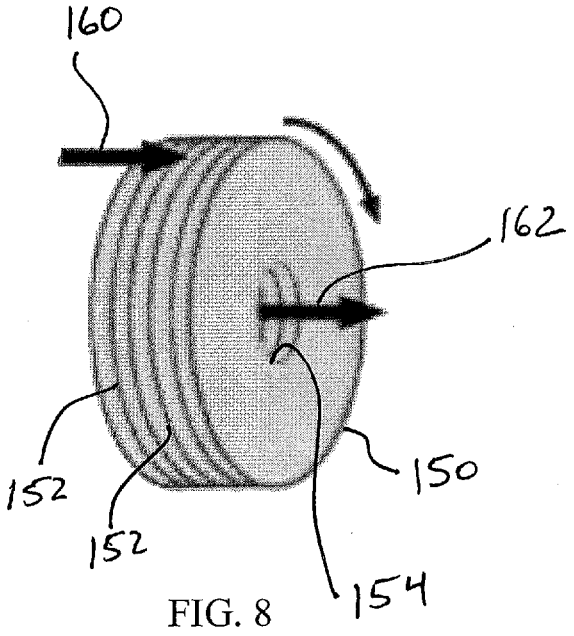
FIG. 8 is a perspective view of a wadding, sabot, or projectile feature that can be part of a projectile apparatus according to various embodiments of the present invention, and showing how high pressure gas or fluid is directed tangentially toward the outer disks of a Tesla turbine structure, spirals inwardly, and exits from the center.

While many mechanical and electromechanical means and devices might be considered to induce high rates of projectile spin, and not all involve turbines, a Tesla turbine structure can be a preferred turbine feature for inducing spin. According to various embodiments of the present invention, the projectile apparatus comprises a Tesla turbine structure comprising a bladeless centripetal flow turbine, for example, as schematically exemplified in FIG. 8. As shown in FIG. 8, a Tesla turbine structure 150 is provided and comprises a plurality of disks 152. High pressure gas or fluid is directed tangentially in the direction shown by directional arrow 160, toward the outer surfaces of the disks of the Tesla turbine structure, spirals inwardly, and exits as low pressure exhaust from a center 154 of the structure, in the direction shown by directional arrow 162. Such a structure can be referred to as a boundary layer turbine because it uses the boundary layer effect, and not a fluid impinging effect, on the turbine blades.

Such embodiments of the present invention can combine aspects of both impulse and reaction mechanisms.

The turbine structure can comprise a plurality of smooth disks spaced apart from one another by a small distance, and can comprise a nozzle that applies a high pressure, high velocity, working fluid, tangentially to the edge of the disks. The fluid drags on the disk due to viscosity and surface adhesion, and, as the gas slows and adds rotational kinetic energy to the disks, it spirals to the center exhaust port and exits at lower velocity and pressure. According to the various embodiments of the present invention, this embodiment is simplistic and provides superior efficiency over bladed turbines.

In yet another embodiment of the present invention, a rotation-producing device, means, element, feature or combination thereof is provided that converts the velocity of burning propellant gases to rotation and can comprise magnets and a magnetohydrodynamic turbine. In such embodiments, the kinetic energy of ionized gases can be converted to torque and rotational energy of the projectile by channeling them through strong magnetic fields. The propellant can comprise salts that increase the degree of ionization of the burning propellant.

Figure 9A:
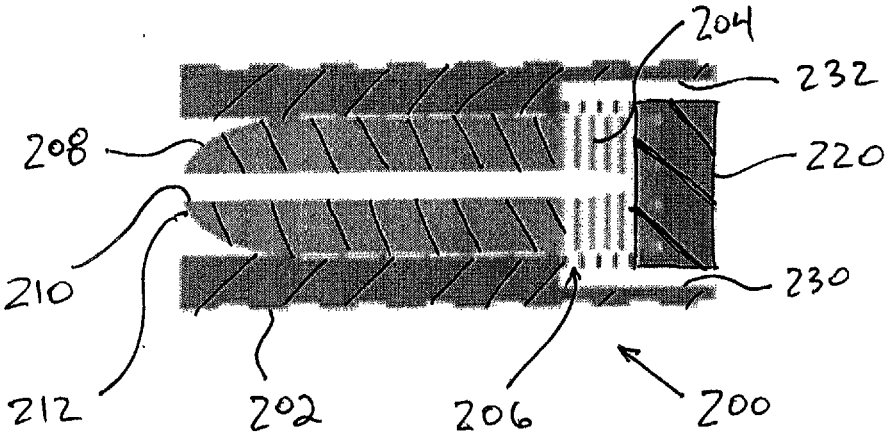
FIG. 9A is a cross-sectional side view of a projectile apparatus according to various embodiments of the present invention and comprising a sabot configured to jet combustion gases tangentially into the disks of a Tesla turbine. Reduced pressure exhaust gases are vented forwardly, ahead of the projectile and sabot.
Figure 9B:
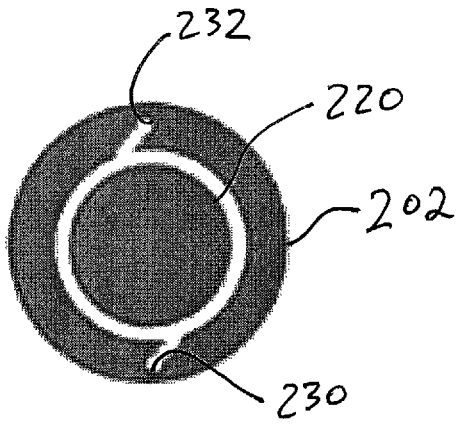
FIG. 9B is a back end view of the projectile apparatus shown in FIG. 9A.

In yet other embodiments of the present invention, as exemplified in FIGS. 9A and 9B, a projectile apparatus 200 is provided wherein propellant combustion gases enter a sabot 202, either directly or through a wadding 220, and are directed tangentially to disks 204 forming a Tesla turbine structure 206 that is integral to a projectile 208. FIGS. 9A and 9B are a cross-sectional view and a back end view, respectively, of sabot 202. Sabot 202 is configured to jet combustion gases from jets 230 and 232 tangentially into the disks. Reduced pressure exhaust gases are vented forwardly, ahead of projectile 208 and sabot 202, and are vented to exit through an exhaust port 210 located at a front end 212 of projectile 208. In some cases, the exhaust gases can be directed to add complementary rotational thrust, for example, such that the projectile spins inside the sabot. Elements or features can be utilized to decrease friction between the projectile and sabot. In other embodiments, sabot 202 can comprise the Tesla turbine structure and exhaust gases can be jetted from a wadding or an intermediary element.

Friction-reducing devices, compositions, and other elements or features that can comprise bearings, ball bearings, sleeves, lubricants, lubricious materials, and surfaces coated with lubricious films, bearing surfaces, combinations thereof, and the like, can be used. Exemplary lubricants include perfluoropolyethers, such as KRYTOX (available from Dupont™ KRYTOX Performance Lubricants, Wilmington, Del.), DEMNUM (available from Daikin Industries, Ltd., Houston, Tex.), and FOMBLIN (available from Solvay, Cranbury, N.J.). Nylon, polypropylene, polyethylene terephthalate, and poly(tetrafluoroethylene) can be used and are well known for their lubricious bearing qualities. FLUOROSYL 3750 (available from Cytonix, LLC, Beltsville, Md.) and DOW CORNING® 2634 (available from Dow Corning Corporation, Midland, Mich.), are lubricious fluorosilane films for ceramics, glasses, semi-metals, metals, and oxides.

The terms projectile and bullet are used interchangeably herein and are to be regarded as the object that travels to a target upon exiting the smooth bore barrel. As described above, other components can be physically associated with the projectile, such as a sabot, a wadding, or both. The projectile can comprise a dense material, such as a metal. Exemplary metals include iron, copper, lead, tantalum, uranium, tungsten, and all alloys thereof, but can also, or instead, be composed of or combined with other metals, metal oxides, alloys, ceramics, plastics, or the like. The projectile can comprise magnetic components, ferromagnetic components, rare earth magnetic components, ceramic magnetic components, or combinations thereof. The projectile can comprise, for example, copper having a density of 8.92 grams per cubic centimeter, lead having a density of 11.34 grams per cubic centimeter, tantalum having a density of 16.654 grams per cubic centimeter, uranium having a density of 18.95 grams per cubic centimeter, or tungsten having a density of 19.25 grams per cubic centimeter. Projectiles comprising one or more of the aforementioned metals but at one or more different densities can also be used.

Projectiles of the present invention can be solid, hollow, chambered, channeled, have nozzles, have ports, or have other functional elements and features. In some embodiments, the projectile can comprise liquid or solid fuels and/or propellants, volatile liquids, oxidizable metals and materials, and air-breathing or self-oxidizing propulsion devices, means, elements and features. In some embodiments, the projectile can be integral with a turbine rotor.

In yet other embodiments of the present invention, the projectile can comprise an in-line stack or other configuration of smaller sub-projectiles, a flight-stable twisted plurality of wires, a composite comprising binder and shot, or a fully frangible material.

The projectiles of the present invention can have a length to diameter ratio of 2:1 or greater, for example, of 5:1 or greater. In some embodiments, the length to diameter ratio is 6:1 or greater, 7:1 or greater, 8:1 or greater, 9:1 or greater, or 10:1 or greater. In some embodiments, the length to diameter ratio can be from about 5:1 to about 10:1.

Nose shapes can be selected for minimal drag at velocities of from Mach 1.0 to Mach 3.0, or higher, including Von Karmen, ¾ parabolic, and ×¾ profiles.

According to the various embodiments of the present invention, the projectile can have a caliber of .22, .30, .38, .44, .45, or .50, or otherwise be suitable for ordinary or conventional shotguns used most commonly for hunting and home defense. Other diameters, greater or smaller, can be used. Projectiles with diameters of one inch or more, 3 inches or more, 5 inches or more, or the like, can also be used.

According to present invention, articles, objects, and devices can be formed by molding, injection molding, powder molding, co-injection, stamping, die-cutting, water jetting, laser cutting, laser ablating, thermo-forming, embossing, extruding, machining, micromaching, 3D printing, lithography, photolithography, self-assembly, 3D polymerization, a combination thereof, or the like.

The present invention includes the following numbered aspects, embodiments, and features, in any order and/or in any combination:

1. A projectile apparatus comprising a propellant and a projectile, the projectile apparatus being configured to spin when fired from a smooth bore barrel, the propellant comprising a combustible material that produces exhaust gases when burned, the projectile apparatus being configured to direct exhaust gases from the propellant away from the projectile as the propellant is burned, and the projectile comprising one or more elements or features for converting gas pressure or velocity from the propellant, as the propellant is burned, to a high rate of projectile spin within a smooth bore barrel, wherein the high rate of projectile spin is greater than 30,000 rotations per minute upon exiting the barrel.

2. The projectile apparatus of any preceding or following embodiment/feature/aspect, wherein the one or more elements or features comprises a turbine element, and the turbine element is one of an impulse turbine element, a reactive turbine element, a centripetal turbine element, a Tesla turbine element, or a combination thereof.

3. The projectile apparatus of any preceding or following embodiment/feature/aspect, wherein the one or more elements or features are configured to regulate, control, and direct gases produced by the propellant as the propellant is burned, into the turbine element.

4. The projectile apparatus of claim 3, wherein the one or more elements or features comprises vanes, blades, channels, nozzles, a stator, or a combination thereof.

5. The projectile apparatus of any preceding or following embodiment/feature/aspect, wherein the turbine element is configured to cause the projectile to spin upon burning the propellant.

6. The projectile apparatus of any preceding or following embodiment/feature/aspect, wherein the high rate of projectile spin upon exiting the barrel is greater than 100,000 rotations per minute.

7. The projectile apparatus of any preceding or following embodiment/feature/aspect, wherein the high rate of projectile spin upon exiting the barrel is greater than 200,000 rotations per minute.

8. The projectile apparatus of any preceding or following embodiment/feature/aspect, wherein the projectile has an aerodynamic profile conforming to a Von Karmen profile, a ¾ parabola profile, or an x¾ power profile.

9. The projectile apparatus of any preceding or following embodiment/feature/aspect, wherein the projectile comprises a material having a density of from about 8 grams per cubic centimeter to about 19 grams per cubic centimeter.

10. The projectile apparatus of any preceding or following embodiment/feature/aspect, wherein the projectile comprises one or more of copper, lead, tantalum, uranium, and tungsten.

11. The projectile apparatus of any preceding or following embodiment/feature/aspect, wherein the projectile has a caliber of .22, .30, .38, .44, .45, or .50.

12. The projectile apparatus of any preceding or following embodiment/feature/aspect, wherein the projectile comprises one or more channels or ducts that begin at, or near, the rear of the projectile and extend to, or near, the front of the projectile, the one or more channels or ducts are configured to convey exhaust gas from the propellant as the propellant is burned, to one or more rotational nozzles or jets configured to direct exhaust to a smooth bore barrel ahead of the projectile.

13. A method comprising:

placing the projectile apparatus of any preceding or following embodiment/feature/aspect, in a smooth bore barrel; and igniting the propellant to cause the propellant to burn and form exhaust gases, wherein the one or more elements or features direct the exhaust gases, the directed exhaust gases cause the projectile to spin in the smooth bore barrel, and the exhaust gases cause the projectile to exit the smooth bore barrel at a rate of projectile spin that is greater than 30,000 rotations per minute.

14. The method of any preceding or following embodiment/feature/aspect, wherein the rate of projectile apparatus spin is greater than 100,000 rotations per minute.

15. The method of any preceding or following embodiment/feature/aspect, wherein the projectile apparatus exits the smooth bore barrel at a muzzle velocity, and the muzzle velocity is from about Mach 1.0 to about Mach 3.0 or higher.

16. A projectile apparatus comprising a propellant, a projectile, and a sabot, the projectile apparatus being configured to spin when fired from a smooth bore barrel, the propellant comprising a combustible material that produces exhaust gases when burned, the projectile apparatus being configured to direct exhaust gases from the propellant away from the propellant as the propellant is burned, and one or both of the projectile and the sabot comprising one or more elements or features for converting gas pressure or velocity from the propellant, as the propellant is burned, to a high rate of projectile spin within a smooth bore barrel, wherein the high rate of projectile spin is greater than 30,000 rotations per minute upon exiting the barrel.

17. The projectile apparatus of any preceding or following embodiment/feature/aspect, wherein the sabot comprises a turbine element, and the turbine element is one of an impulse turbine element, a reactive turbine element, a centripetal turbine element, a Tesla turbine element, or a combination thereof.

18. The projectile apparatus of any preceding or following embodiment/feature/aspect, wherein the sabot comprises one or more elements or features configured to regulate, control, and direct gases produced by the propellant as the propellant is burned, into the turbine element.

19. The projectile apparatus of any preceding or following embodiment/feature/aspect, wherein the one or more elements or features comprises vanes, blades, channels, nozzles, a stator, or a combination thereof.

20. The projectile apparatus of any preceding or following embodiment/feature/aspect, wherein the projectile apparatus comprises one or more channels or ducts from at, or about, the rear of the projectile apparatus to at, or about, the front of the projectile apparatus, the one or more channels or ducts are configured to convey exhaust gas from the propellant as the propellant is burned, to one or more rotational nozzles or jets configured to direct exhaust to a smooth bore barrel ahead of the projectile apparatus.

21. The projectile apparatus of any preceding or following embodiment/feature/aspect, further comprising an intermediary component, wherein the intermediary component comprises one or more elements or features configured to regulate, control, and direct gases produced by the propellant as the propellant is burned, into the turbine element.

22. The projectile apparatus of any preceding or following embodiment/feature/aspect, the projectile further comprising a device or means, wherein the device or means comprise an element or feature for reducing drag, adding thrust, or both, and which comprises an air breathing or self-oxidizing element or feature.

23. A system comprising the projectile apparatus of any preceding or following embodiment/feature/aspect and a smooth bore barrel, wherein the sabot is configured to have substantially greater friction against the smooth bore barrel and reduced propensity to rotate, compared to the projectile.

24. A method comprising:

placing the projectile apparatus of any preceding or following embodiment/feature/aspect, in a smooth bore barrel; and igniting the propellant to cause the propellant to burn and form exhaust gases, wherein the one or more elements or features direct the exhaust gases, the directed exhaust gases cause the projectile to spin in the smooth bore barrel, and the exhaust gases cause the projectile to exit the smooth bore barrel at a rate of projectile spin that is greater than 30,000 rotations per minute.

25. The method of any preceding or following embodiment/feature/aspect, wherein the rate of projectile spin is greater than 100,000 rotations per minute.

26. The method of any preceding or following embodiment/feature/aspect, wherein the projectile exits the smooth bore barrel at a muzzle velocity, and the muzzle velocity is from about Mach 1.0 to about Mach 3.0 or greater.

27. A projectile apparatus comprising a propellant, a projectile, and a wadding, the projectile apparatus being configured to spin when fired from a smooth bore barrel, the propellant comprising a combustible material that produces exhaust gases when burned, the projectile apparatus being configured to direct exhaust gases from the propellant away from the propellant as the propellant is burned, and one or both of the projectile and the wadding comprising one or more elements or features for converting gas pressure or velocity from the propellant, as the propellant is burned, to a high rate of projectile spin within a smooth bore barrel, wherein the high rate of projectile spin is greater than 30,000 rotations per minute upon exiting the barrel.

28. The projectile apparatus of any preceding or following embodiment/feature/aspect, wherein the wadding comprises a turbine element, and the turbine element is one of an impulse turbine element, a reactive turbine element, a centripetal turbine element, a Tesla turbine element, or a combination thereof.

29. The projectile apparatus of any preceding or following embodiment/feature/aspect, wherein the wadding comprises one or more elements or features are configured to regulate, control, and direct gases produced by the propellant as the propellant is burned, into the turbine element.

30. The projectile apparatus of any preceding or following embodiment/feature/aspect, wherein the one or more elements or features comprises vanes, blades, channels, nozzles, a stator, or a combination thereof.

31. The projectile apparatus of any preceding or following embodiment/feature/aspect, wherein the wadding comprises one or more channels or ducts from at, or about, the rear of the projectile to at, or about, the front of the projectile, the one or more channels or ducts are configured to convey exhaust gas from the propellant as the propellant is burned, to one or more rotational nozzles or jets configured to direct exhaust to a smooth bore barrel ahead of the projectile.

32. The projectile apparatus of any preceding or following embodiment/feature/aspect, further comprising an intermediary component, wherein the intermediary component comprises one or more elements or features configured to regulate, control, and direct gases produced by the propellant as the propellant is burned, into the turbine element.

33. The projectile apparatus of any preceding or following embodiment/feature/aspect, the projectile further comprising a device or means, wherein the device or means comprise an element or feature for reducing drag, adding thrust, or both, and which comprises an air breathing or self-oxidizing element or feature.

34. The projectile apparatus of any preceding or following embodiment/feature/aspect, further comprising a sabot and an intermediary component, wherein the intermediary component is positioned between the wadding and the sabot and comprises a mechanical coupling between the wadding and the sabot.

35. A system comprising the projectile apparatus of any preceding or following embodiment/feature/aspect and a smooth bore barrel, wherein the wadding is configured to have substantially greater friction against the smooth bore barrel and reduced propensity to rotate, compared to the projectile.

36. A method comprising:

placing the projectile apparatus of any preceding or following embodiment/feature/aspect, in a smooth bore barrel; and igniting the propellant to cause the propellant to burn and form exhaust gases, wherein the one or more elements or features direct the exhaust gases, the directed exhaust gases cause the projectile to spin in the smooth bore barrel, and the exhaust gases cause the projectile to exit the smooth bore barrel at a rate of projectile spin that is greater than 30,000 rotations per minute.

37. The method of any preceding or following embodiment/feature/aspect, wherein the rate of projectile spin is greater than 100,000 rotations per minute.

38. The method of any preceding or following embodiment/feature/aspect, wherein the projectile exits the smooth bore barrel at a muzzle velocity, and the muzzle velocity is from about Mach 1.0 to about Mach 3.0 or more.

39. A method for inducing a high rate of spin on a projectile in a barrel having a smooth bore;

the method comprising causing a propellant to burn and produce combustion gases at pressures of about 10,000 PSI or more in the form of potential energy;

coupling a turbine element to a projectile, the turbine elements being configured to convert potential energy of the combustion gases to kinetic rotational energy of the coupled turbine element and projectile; and using the turbine element to convert the potential energy into kinetic rotational energy of the coupled turbine element and projectile to cause the projectile to spin at a rate of 30,000 RPM or greater.

40. The method of any preceding or following embodiment/feature/aspect, wherein a wadding, sabot, or both, are further coupled to the turbine element and projectile to regulate, control and direct the flow of combustion gases into the turbine element, thereby increasing efficiency of the conversion from the potential energy to the kinetic rotational energy.

41. The method of any preceding or following embodiment/feature/aspect, wherein drag on the projectile after leaving the barrel is reduced or the projectile velocity after leaving the barrel is substantially maintained or increased.

42. The method of any preceding or following embodiment/feature/aspect, wherein the using the turbine element to convert causes the projectile to spin at a rate of 300,000 RPM or greater.

43. The projectile apparatus of any preceding or following embodiment/feature/aspect, wherein a rotation-producing device, means, element, feature or combination thereof is provided that converts the velocity of burning propellant gases to rotation and can comprise magnets and a magnetohydrodynamic turbine. In such embodiments, the kinetic energy of ionized gases can be converted by strong magnetic fields to torque and rotational energy of the projectile. The propellant can comprise salts and additives that increase the degree of ionization of the burning propellant.

44. A method comprising:

placing the projectile apparatus of any preceding or following embodiment/feature/aspect, in a smooth bore barrel; and igniting the propellant to cause the propellant to burn and form ionized exhaust gases, wherein the one or more devices, means, elements or features direct the ionized exhaust gases through a magnetic field, the directed ionized exhaust gases interacting with magnetic fields cause the projectile to spin in the smooth bore barrel, and the ionized exhaust gases cause the projectile to exit the smooth bore barrel at a rate of projectile spin that is greater than 30,000 rotations per minute.

The present invention can include any combination of these various embodiments, features, and aspects above as set forth in sentences and/or paragraphs. Any combination of disclosed features herein is considered part of the present invention and no limitation is intended with respect to combinable features.

The entire contents of all references cited in this disclosure are incorporated herein in their entireties, by reference. Further, when an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether such ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

Other embodiments of the present invention will be apparent to those skilled in the art from consideration of the present specification and practice of the present invention disclosed herein. It is intended that the present specification and examples be considered as exemplary only, with a true scope and spirit of the invention being indicated by the following claims and equivalents thereof.

What is claimed is:

1. A projectile apparatus comprising a propellant and a projectile, the projectile apparatus being configured to spin when fired from a smooth bore barrel, the propellant comprising a combustible material that produces exhaust gases when burned, the projectile apparatus being configured to direct exhaust gases from the propellant away from the projectile as the propellant is burned, and the projectile comprising one or more elements or features for converting gas pressure or velocity from the propellant, as the propellant is burned, to a high rate of projectile spin within the smooth bore barrel, wherein the one or more elements or features comprises an impulse turbine element having blades, and a stator defining a plurality of nozzles configured to direct the exhaust gases into the blades of the impulse turbine element, and the high rate of projectile spin is greater than 30,000 rotations per minute upon exiting the barrel.

2. The projectile apparatus of claim 1, wherein the one or more elements or features are configured to regulate, control, and direct gases produced by the propellant, as the propellant is burned, into the turbine element.

3. The projectile apparatus of claim 2, wherein the one or more elements or features further comprises vanes, blades, channels, vents, magnets, or a combination thereof.

4. A projectile apparatus comprising a propellant, a projectile, and a sabot, the projectile apparatus being configured to spin when fired from a smooth bore barrel, the propellant comprising a combustible material that produces exhaust gases when burned, the projectile apparatus being configured to direct exhaust gases from the propellant away from the propellant as the propellant is burned, and one or both of the projectile and the sabot comprising one or more elements or features for converting gas pressure or velocity from the propellant, as the propellant is burned, to a high rate of projectile spin within the smooth bore barrel, wherein the one or more elements or features comprises a turbine element, wherein the sabot comprises the turbine element, the turbine element is an impulse turbine element, the impulse turbine elements has blades, the one or more elements or features further comprises a stator defining a plurality of nozzles configured to direct the exhaust gases into the blades of the impulse turbine element, and the high rate of projectile spin is greater than 30,000 rotations per minute upon exiting the barrel.

5. A projectile apparatus comprising a propellant, a projectile, and a wadding, the projectile apparatus being configured to spin when fired from a smooth bore barrel, the propellant comprising a combustible material that produces exhaust gases when burned, the projectile apparatus being configured to direct exhaust gases from the propellant away from the propellant as the propellant is burned, and one or both of the projectile and the wadding comprising one or more elements or features for converting gas pressure or velocity from the propellant, as the propellant is burned, to a high rate of projectile spin within the smooth bore barrel, wherein the one or more elements or features comprises a turbine element, wherein the projectile comprises the turbine element, the turbine element comprises blades, the wadding comprises a stator defining a plurality of nozzles configured to direct the exhaust gases into the blades of the turbine element and configured to regulate, control, and direct gases produced by the propellant as the propellant is burned, into the turbine element, and the high rate of projectile spin is greater than 30,000 rotations per minute upon exiting the barrel.

6. The projectile apparatus of claim 5, wherein the one or more elements or features further comprises vanes, channels, vents, magnets or a combination thereof.

* * * * *